United States Patent [19]

Storandt

[11] 4,290,624

[45] Sep. 22, 1981

[54] RELEASE SETTING INDICATING DEVICE FOR A SKI SAFETY BINDING

[75] Inventor: Ralf Storandt, Leonberg, Fed. Rep. of Germany

[73] Assignee: Vereinigte Baubeschlagfabriken Gretsch & Co. GmbH, Leonberg, Fed. Rep. of Germany

[21] Appl. No.: 65,543

[22] Filed: Aug. 10, 1979

Related U.S. Application Data

[63] Continuation-in-part of Ser. No. 2455, Jan. 10, 1979.

[30] Foreign Application Priority Data

Aug. 16, 1978 [DE] Fed. Rep. of Germany ..... 2835733

[51] Int. Cl.[3] ..... A63C 9/08

[52] U.S. Cl. ..... 280/634; 116/DIG. 11

[58] Field of Search ..... 280/611, 634; 116/DIG. 11

[56] References Cited

U.S. PATENT DOCUMENTS

| | | | |
|---|---|---|---|
| 3,865,390 | 2/1975 | Pradillon | 280/634 |
| 3,866,930 | 2/1975 | Salomon | 280/634 |
| 3,888,498 | 6/1975 | Gertsch et al. | 280/634 |
| 3,905,611 | 9/1975 | Sittmann | 280/634 X |

FOREIGN PATENT DOCUMENTS

| | | | |
|---|---|---|---|
| 1534441 | 6/1968 | France | 280/634 |

*Primary Examiner*—Joseph F. Peters, Jr.
*Assistant Examiner*—Michael Mar

[57] ABSTRACT

A release setting indicating device for use in a ski safety binding which utilizes two concentric coil springs to preload the release mechanism. The inner and outer coil springs are respectively associated with the sideways and upward release mechanisms of a diagonal release binding and are provided with independently adjustable abutments at their ends remote from the sole clamp. A tube surrounds the inner coil spring with a certain degree of sideways clearance and has a projection which extends towards the sole clamp beyond the end of the outer coil spring. This projection carries an indicator member which is visible through a window provided in the binding housing. The tube is connected via a radially inwardly directed flange to the inner coil spring via the adjustable abutment so that the indicator member is axially displaced to show the release setting of the spring on adjustment of the abutment. The projection is conveniently a sliding fit in a recess in the housing and simultaneously prevents torque being applied to the inner coil spring from its associated adjustable abutment. An indicating device is also provided for the outer coil spring and comprises a second window in the binding housing through which the position of the adjustable abutment associated with the outer coil spring can be viewed.

25 Claims, 3 Drawing Figures

RELEASE SETTING INDICATING DEVICE FOR A SKI SAFETY BINDING

Figure 1:
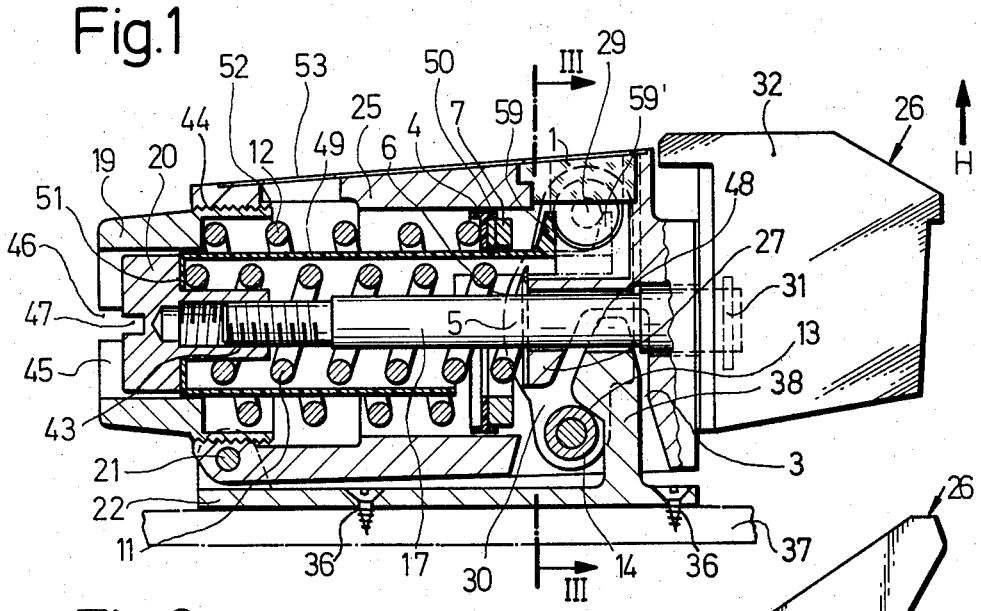

This application relates to a release setting indicating device for release mechanism associated with the sole clamp of a ski safety binding and is a continuation in part of my co-pending U.S. patent application Ser. No. 2455 filed Jan. 10, 1979, and entitled "a safety binding for a ski."

The afore-mentioned copending application relates to a ski safety binding of the diagonal release type which features separate sideways and upward release mechanisms respectively preloaded by means of respective ones of two concentric inner and outer coil springs. The release settings of these coil springs are adjustable by means of respective adjustable abutments provided at the ends of the springs remote from the sole clamp. The adjustable abutments are independently adjustable for varying the release settings (or release hardness) of the sideways and upward release mechanisms.

It is already known for example from FR-PS No. 22 01 107 and DE-OS No. 22 02 541 to provide a window in a ski binding so that an indicator member associated with the adjustable abutment of a coil spring can be seen from outside the binding. In this way an adjustment of the position of the abutment nut and thus a change of the release setting of the binding is visible from outside of the binding. Usefully markings are provided in the window which provide a measure for the release setting of the binding.

In my above referenced earlier patent application the arrangement of two coil springs of different diameter one within the other in order to provide independently adjustable release settings for the sideways and vertical release mechanisms gives rise to problems in providing a suitable indication of the release setting of the inner coil spring and of the associated release mechanism because of the presence of the outer coil spring. This problem, whilst specific to the arrangement of my earlier application is also a general problem in connection with safety ski bindings incorporating two concentrically arranged coil springs.

It is a principal object of the present invention to provide a release setting indicating device of simple construction which can be readily assembled and enables an indication of the release setting of the inner one of two coil springs.

It is a further object of the present invention to provde a very robust and operationally reliable release setting indicating device.

Further objects of the present invention will become clear from the following description and claims.

According to the present invention there is provided in its most general form a release setting indicating device for release mechanism associated with the sole clamp of a ski safety binding and incorporating a first inner coil spring located within a second outer coil spring, there being means for independently adjusting the positions of the ends of the inner and outer coil springs and remote from the sole clamp to adjust the release settings of the release mechanism and wherein said indicating device is adapted to indicate the release setting of the inner coil spring and comprises a tube surrounding said inner coil spring with play therebetween, means constraining the tube for axial movement together with the adjustment end of the inner coil spring, the tube having an axial projection at its other end which projects beyond the adjacent end of the outer coil spring to a position in which the projection is visible from outside the binding.

Preferably an indicator member which is directed radially outwardly is provided at the end of the axial projection. In this manner the movement of the adjustable end of the inner spring which takes place on an adjustment of the release setting of the inner spring is transmitted via the tube to the projection. As the projection projects into a region beyond the outer coil spring it is readily possible to arrange a viewing window in this region through which the position of the projection can be viewed.

As the adjustment of the spring tension preferably takes place via an adjustable abutment in the form of an adjustment nut or other threaded member a torque is generally transmitted to the tube and thus to the projection during adjustment of the release setting. The effects of this torque can however be overcome by holding the projection against turning movement about the tube axis by means of fixed housing parts. In this connection the stability of a tube and its ability to withstand torsional moments makes itself advantageously noticable so that on adjustment of the release setting of the inner spring and despite the generally large distance between the adjusting member and the projection no unwanted wind-up of the tube occurs. The axial displacement between the spring and the tube which occurs on adjustment of the release setting can take place unhindered by frictional effects due to the play, or clearance, between the tube and the inner coil spring.

The length of the tube could be less than the length of the inner coil spring in its most compressed operating condition so that the tube is not trapped between the two spring abutments at either end of the inner coil spring. Preferably the length of the tube is only a little less than the smallest length of the inner coil spring in order to ensure optimum guiding of the projection and optimum torsional stiffness.

The projection usefully has the same curvature as the tube so that the projection matches the curvature of the spring in the same manner as the tube. In this way the tube and projection can be simply manufactured in one piece by cutting them out of tube material.

It is especially advantageous if the tube has a radially inwardly directed flange at the adjustment end of the spring which engages behind this end of the spring. The adjustment nut then usefully engages on the side of the flange remote from the spring thus sandwiching the flange between the adjustable abutment nut and the spring.

This embodiment brings the additional advantage that the torque which is otherwise exerted by the adjustment nut on the coil spring is fully taken up by the tube and is transmitted via the projection to the binding housing. In this way torsion is not introduced into the inner coil spring during adjustment which favourably influences the reproducability of the desired release setting.

From the technical manufacturing view point it is particularly advantageous if the tube together with the projection and any indicator member is manufactured in synthetic material such as plastic e.g. by injection molding.

It is furthermore useful if the projection and the indicator member are arranged upwardly in the binding where they can be best recognized.

The springs and the tube preferably extend in the longitudinal direction of the ski.

The invention can be used with especial advantage in the ski safety bindings disclosed and claimed in my earlier patent application U.S. Ser. No. 2445.

In both of these arrangements the inner coil spring bears at its end adjacent the sole clamp on a housing part and the corresponding end of the outer coil spring either likewise bears on the housing part or on actuating mechanism projecting into openings in the housing part. In this preferred embodiment the housing part should preferably have a cut out between the afore-mentioned openings into which the projection projects. In order to avoid the entry of dirt the viewing side of the cut out is usefully closed by a window. Preferably the projection, and if necessary the indicator member are slidably accommodated in the cut out, the boundaries of which form a seat for the projection and any indicator member so that not only is the desired rotational location of the tube ensured but also play in the peripheral direction is avoided.

Preferably a second window is also arranged in the housing through which the edge of the adjustment member for the outer spring is visible. In this case the release settings of both springs can be recognized from outside of the binding.

An especially practical realization of the thought underlying the invention envisages that the inner spring preloads the side release mechanism via a rod connected to the adjustment nut and the outer coil spring preloads the vertical release mechanism via mechanical actuating members. In this arrangement the adjustment members are usefully formed by the adjustment nut which is screw-threaded onto the end of the rod and which engages the flange of the tube and an adjustable abutment arranged coaxially outside of the adjustment nut the edge of which is visible through the second window. The adjustment nut is conveniently located within the adjustable abutment.

Figure 2:
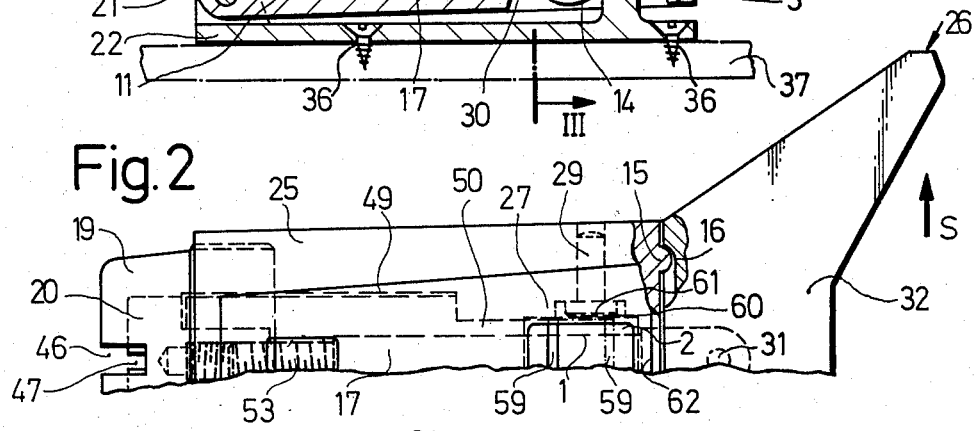
Figure 3:
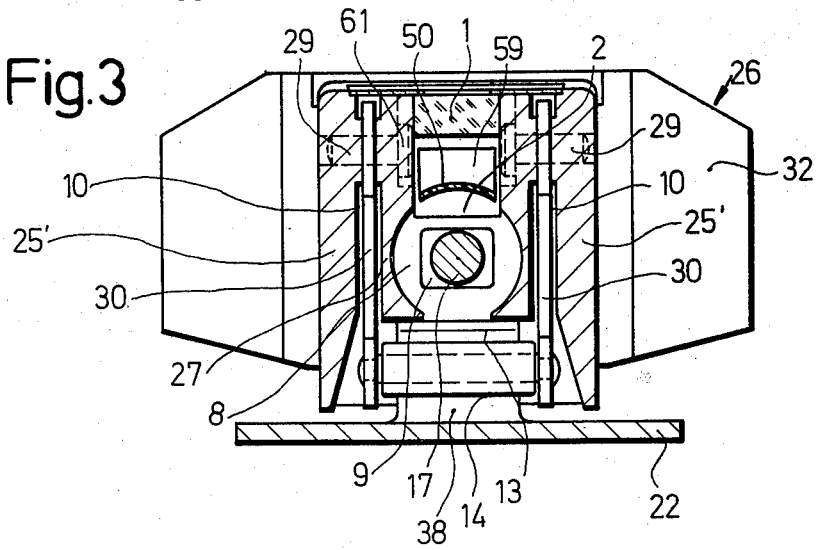

The invention will now be practically described by way of example only and with reference to the accompanying drawings in which are shown:

FIG. 1 a partially sectioned side elevation of a ski safety binding incorporating the release setting indicating device of the present invention, FIG. 2 a partially sectioned plan view taken to one side of the central longitudinal axis of the binding of FIG. 1 and FIG. 3 a section on the line III—III of FIG. 1.

In FIGS. 1 to 3 there is shown a ski safety binding of the diagonal type in which the sole clamp can move sideways and upwardly to effect respectively sideways and vertical release of a ski boot clamped by its sole by the binding to a ski. The binding shown can be used both as a front toe binding and also as a heel binding.

The binding features a base plate 22 with a binding housing 25 pivotally mounted on the base plate about a transverse pivot axis 21. The base plate 22 is fastened by means of screws 36 to the ski schematically illustrated at 37. The housing 25 carries at its end which faces the sole of the ski boot a sole clamping device 26 which in general is defined by the one piece sole clamp 32. The transverse axis 21 is provided at the end of the housing remote from the sole clamping device 26 in order to make possible an unhindered upward movement of the housing 25 (together with the sole clamp 32) during vertical release. The vertical release mechanism has a component 38 which extends upwardly from the base plate 22 and has a release cam track 13 at its end face remote from the sole clamp 33. This release cam track 31 cooperates with a latch journal 14 which connects together two links 30 by their lower ends. The links 30 are pressed sheet metal parts and are so arranged that the normals to their planes lie in the transverse direction. The links 30 are pivotally fastened in the vicinity of their upper ends about a transverse axis 29 to the housing 25 by means of respective headed pins 61.

As seen at 62 a housing support part 27 extends downwardly via a material bridge from the upper region of the housing 25 in the immediate vicinity of the sole clamp 32. Two slit—like through-passages 10 are located between the side regions 25' (FIG. 3) of the housing 25 and the support wall part 27 and the aforementioned links 30 extend downwardly through the slit-like openings 10.

The component 38 carrying the release cam track 13 extends, as can be seen in FIG. 1, into a recess 3 of the housing part 27 when the ski binding is in the closed position i.e. prior to vertical release. In the region remote from the sole clamping device 26 the housing part 27 extends further downwardly in order to define a generally circular abutment surface 8 at its end face remote from the sole clamp (FIG. 3) for an inner release coil spring 11. The other end of the inner coil spring 11 bears on an abutment nut 20 which is screw-threaded onto the threaded end 43 of a rod 17. The rod 17 which is loaded in tension extends through the center of the inner spring 11 back to the housing support part 27 and extends with clearance, especially in the sideways direction, through a through-passage 9 in the housing support part. The rod is pivotally connected via a vertical axis to the sole clamp 32. As a result of this construction the inner spring 11 pulls the sole clamp 32 via the rod 17 against nose-like pivot projections 15 arranged on and to either side of the housing 25. On the occurrence of an excessive sideways force in the direction of the arrow S of FIG. 2 the sole clamp 32 pivots by means of the abutment surface 16 about the nose-like pivot projection 15 which results in the inner coil spring 11 being compressed via the rod 17. A sideways release in the other sideways direction takes place in analogous fashion.

The vertical release mechanism formed by the release come track 13 and the latch journal 14 is preloaded via the links 30 from an outer compression coil spring 12 arranged concentrically with the inner coil spring 11 and of larger diameter. The end of the outer coil spring 12 remote from the sole clamp 32 bears on an abutment screw 19 which is screw-threaded into threads 44 in the end face of the housing 25 remote from the sole clamp 32. The abutment screw 19 has a concentrically disposed inner cavity 45 in which the previously mentioned abutment nut 20 of the inner coil spring 11 is freely rotatably arranged.

Both the abutment nut 20 and also the abutment screw 19 have actuating slots 46 or 47 in their end faces into which, for example, a screw driver or coin can be inserted. Depending on the tool that is used the abutment nut 30 and the abutment screw 19 can be independently or jointly adjusted.

The end of the outer coil spring 12 adjacent to the sole clamping device 26 and which is associated with the upward release mechanism is arranged in a synthetic bearing ring 4 having a peripheral margin. The synthetic bearing ring 4 accommodates an abutment ring 7 at its side facing away from the outer coil spring 12. The abutment ring 7 is usefully formed in metal and has rounded depressions 6 on both sides as can be seen in FIG. 1. Corresponding rounded cam-like projections 5 on the links 30 engage in these depressions. In this manner the compressive preload of the outer coil spring 12 which defines the upward release setting is transmitted via the rings 4 and 7 to the links 30 and thus to the latch journal 14.

A cut-out 2 is provided in the upper region of the housing support part 27. As however can be seen from FIG. 2 this cut-out extends forwardly from the spring side at the housing support part only up to the material bridge 62. In this cut-out there are located recesses 60 into which the heads of the pins 61 defining the pivot axis 29 fit. The associated pins can thus be introduced into their associated transverse bores in the housing 25 via the cut-out 2.

A tube 49 of synthetic material is slid over the inner coil spring 11 with a clearance on all sides. The tube has a radially inwardly directed flange 51 at its end remote from the sole clamping device 26. The flange 51 lies between the abutment nut 20 and the end of the inner coil spring 11.

The end of the tube 49 adjacent the sole clamping device 26 finishes sufficiently far in front of the corresponding end of the inner coil spring 11 that in the most strongly compressed operating condition of the spring 11 the tube 49 just avoids contact with the abutment surface 8 for the inner coil spring 11. The external diameter of the tube 49 is so chosen that it can pass with little play through the rings 4 and 7. As the internal diameter of the rings 4, 7 and the outer diameter of the tube 49 are constant the play between the two parts can be kept very small and the rings can be guided on the tube. As however the diameter of the inner spring 11 increases on compression the play between the spring 11 and the internal wall of the tube 49 must be made correspondingly larger.

A projection 50 extends in the manner which can be seen from FIGS. 2 and 3 from the end of the tube 49 adjacent the sole clamping device into the cut-out 2. The projection 50 fits with trivial sideways clearance exactly into the cut out 2 and has an upwardly directed indicator member 59 at its end. The indicator member 59 is shown in chain dotted lines in a second position 59' in FIG. 1 illustrating the provision adopted by the indicator member when a relatively hard release setting has been chosen.

A window 1 through which the indicator member 59 is visible extends above and over the range of axial displacement of the indicator member. A scale provided on the window (not illustrated) provides a quantitative measure of the selected release setting. The window is conveniently defined by a piece of transparent synthetic material.

A second viewing window 53 is provided at the upper side of the binding housing 25 at its end remote from the sole clamping device 26. The inner edge of the outer adjustment screw 19 is visible through this window 53. A scale for the release setting can also be provided on the window 53 so that the release setting of the outer coil spring 12 can also be checked.

The manner of operation of the ski safety binding in accordance with the invention is as follows:

On the occurrence of an excessive force in the direction of the arrow H of FIG. 1 the housing 25 pivots upwardly about the transverse axis 21 into an open position (not shown). During this pivotal movement the latch journal 14 moves upwardly over the apex of the release cam track 13. As a result the outer coil spring 12 (i.e. the compression coil spring associated with upward release) is compressed via the links 30 and the rings 4 and 7. The housing 25 is held in the open position by the force of the spring 12 by virtue of the inclined edge 48 at the upper part of the component 38 which is oppositely disposed to the release cam track 13 until the binding is guided into the closed position of FIG. 1. This can for example take place by pressing on the binding from above by hand.

The sideways release takes place completely independently of the upward release on the occurrence of an excessive force in the direction of the arrow S of FIG. 2. During sideways release the abutment surface 16 pivots about the associated nose-like pivot projection 15 and the inner coil spring 11 is compressed via the rod 17.

Because of the arrangement of the invention both release springs can be independently adjusted by the introduction of tools into the slots 46 or 47 or can also be jointly adjusted. As a result of the adjustment one or both of the edge 52 of the abutment screw 19 and the indicator member 59 are displaced by corresponding amounts and indicate the preloaded condition of the associated springs 12, 11.

It will be apparent to those skilled in the art that further modifications can be made to the arrangements herein disclosed without departing from the scope of the present teaching.

I claim:

1. A release setting indicating device for a ski safety binding having sole clamp means retainable in a skiing position by first and second release mechanisms the release settings of which are respectively determined by first and second coil springs, wherein said first coil spring is disposed within said second coil spring and means are provided for independently adjusting the positions of respective adjustment ends of the first and second coil springs that are spatially remote from said first and second release mechanisms to adjust the release settings thereof, and wherein said indicating device is adapted to indicate the release setting of the first inner coil spring and comprises a tube surrounding said inner coil spring with play therebetween, and means constraining the tube for axial movement together with said adjustment end of the inner coil spring, said tube having an axial projection at its other end which projects beyond the adjacent end of the outer coil spring to a position in which said projection is visible from outside the binding.

2. A release setting indicating device according to claim 1 and wherein said projection is axially aligned with the wall of said tube.

3. A release setting indicating device according to claim 1 and wherein an indicator member projects radially outwardly from the end of said projection.

4. A release setting indicating device according to claim 1 and wherein the length of the tube is smaller than the length of the inner coil spring in its most compressed operating condition.

5. A release setting indicating device according to claim 1 and wherein said projection has the same curvature as the tube.

6. A release setting indicating device according to claim 5 and wherein the circumferential extent of the projection lies in the range of $\frac{1}{4}$ to $\frac{1}{8}$ of the circumference of the tube.

7. A release setting indicating device according to claim 5 and wherein the circumferential extent of the projection lies in the range $\frac{1}{4}$ to $\frac{1}{8}$ of the circumference of said tube.

8. A release setting indicating device according to claim 5 and wherein the circumferential extent of the projection amounts to substantially 1/6 of the circumference of said tube.

9. A release setting indicating device according to claim 1 wherein said projection and said tube are made from a single piece of tube material.

10. A release setting indicating device according to claim 1 and wherein said means constraining the tube for axial movement together with the adjustment end of the inner coil spring comprises a radially inwardly directed flange on said tube which engages behind the adjustment end of the inner coil spring.

11. A release setting indicating device according to claim 10 and in which an adjustable abutment nut engages the other side of said flange remote from the adjustment end of the inner coil spring.

12. A release setting indicating device according to claim 1 in which an indicator member is provided on said projection and wherein said tube, said projection and said indicator member are formed in a synthetic material.

13. A release setting indicating device according to claim 1 and wherein an indicator member is provided on said projection and wherein these parts are arranged upwardly disposed within the binding.

14. A release setting indicating device according to claim 1 and wherein the inner and outer coil springs and the tube extend in the longitudinal direction of the binding corresponding to the longitudinal direction of a ski to which the binding is to be attached.

15. A release setting indicating device according to claim 1 and wherein the end of said inner coil spring adjacent the sole clamp is braced against a housing part and wherein the corresponding end of the outer coil spring is braced against one of the said housing part or mechanical actuating members projecting through openings in said housing part and in which a cut-out into which the said projection projects is provided in said housing part.

16. A release setting indicating device according to claim 15 and wherein said cut-out is provided between said openings.

17. A release setting indicating device according to claim 15 and wherein said cut-out is closed on the viewing side by a window.

18. A release setting indicating device according to claim 12 and wherein said projection and any associated indicator member are slidably accommodated in said cut-out.

19. A release setting indicating device according to claim 1 and wherein a first window is provided in said binding for viewing said release setting indicating device, there being further provided a second window for viewing the position of the adjustment member for the outer coil spring.

20. A release setting indicating device according to claim 19 and wherein said second window is disposed to allow viewing of the edge of the adjustment member for the outer coil spring.

21. A release setting indicating device according to claim 19 and wherein said first and second release mechanism comprises a sideways release mechanism respectively and a vertical release mechanism and wherein the inner coil spring loads the sideways release mechanism via a rod and an adjustment nut and the outer coil spring loads the vertical release mechanism via mechanical actuating members.

22. A release setting indicating device according to claim 21 and in which said means for independently adjusting the positions of said adjustment ends respectively comprise an adjustment nut screw-threaded onto the rod which engages a flange of the tube and an adjustable abutment coaxial with said adjustment nut and the edge of which is visible through said second window.

23. A release setting indicating device according to claim 22 and wherein said adjustment nut is located within said adjustable abutment.

24. A release setting indicating device according to claim 19 and in which said first and second windows are arranged one behind each other in the upper side of a binding housing said binding housing being arranged for upward pivotal movement relative to a base plate about a transverse axle.

25. A release setting indicating device according to claim 24 and in which said first and second windows are spaced apart in the longitudinal direction of the housing.

* * * * *